United States Patent [19]

Schaefer et al.

[11] 4,413,788

[45] Nov. 8, 1983

[54] DEVICE FOR THE FEEDING OF ENAMEL TO AN ELECTROSTATIC PAINT EMITTER

[75] Inventors: Gerd Schaefer, Heusenstamm; Winfried Ott, Rodgau; Gunther Fleig, Hanau, all of Fed. Rep. of Germany

[73] Assignee: Ransburg GmbH, Heusenstamm, Fed. Rep. of Germany

[21] Appl. No.: 188,514

[22] Filed: Sep. 18, 1980

[30] Foreign Application Priority Data

Sep. 19, 1979 [DE] Fed. Rep. of Germany ..... 2937890

[51] Int. Cl.[3] ..... B05B 5/02

[52] U.S. Cl. ..... 239/703

[58] Field of Search ..... 239/3, 703; 141/95, 141/193

[56] References Cited

U.S. PATENT DOCUMENTS

| | | | |
|---|---|---|---|
| 3,122,320 | 2/1964 | Beck et al. | 239/703 |
| 3,893,620 | 7/1975 | Rokadia | 239/3 |
| 3,933,285 | 1/1976 | Wiggins | 239/3 |
| 3,934,055 | 1/1976 | Tamny | 239/3 |
| 4,275,834 | 1/1981 | Spanjersberg et al. | 239/3 |

*Primary Examiner*—Jeffrey V. Nase
*Assistant Examiner*—Michael J. Forman
*Attorney, Agent, or Firm*—Barnes & Thornburg

[57] ABSTRACT

A device for feeding an electrically conductive coating material from a supply system to a coating material dispensing device wherein a high electrostatic potential is maintained between the supply system and the device, comprising an intermediate storage container fillable in controlled manner from the supply system to a maximum fill level and connected to the coating material dispensing device by a coating material conduit maintained at substantially the electrostatic potential of the coating material dispensing device, a device provided in the intermediate storage container for breaking up the supply of coating material into the intermediate storage container into electrically separated individual particles, and means for coupling the breakup device to a source of coating material, the breakup device being arranged above the fill level such that, between the breakup device and the interior of the intermediate storage container, a minimum spacing is maintained so that no electrostatic discharge occurs.

9 Claims, 1 Drawing Figure

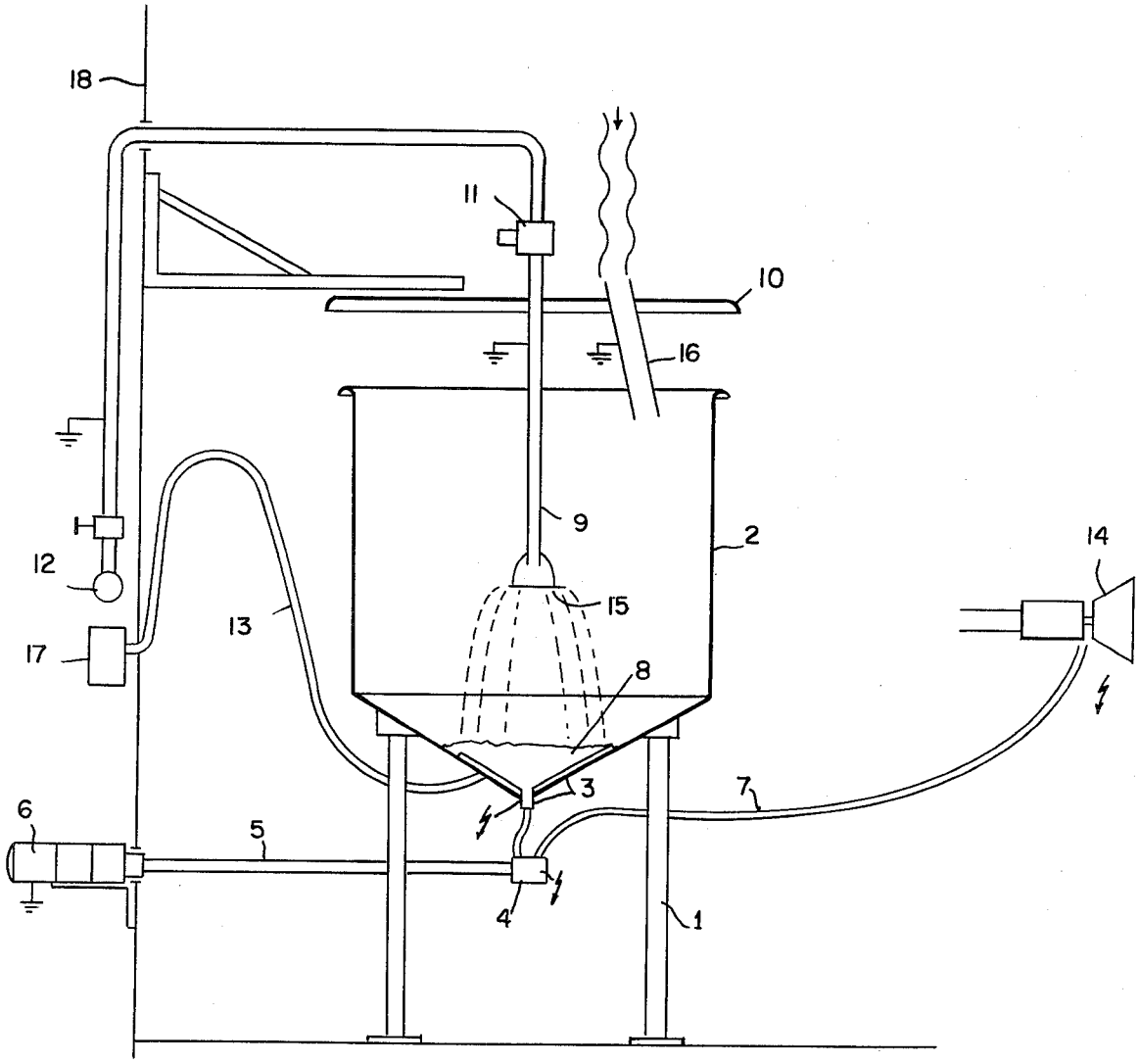
18
11
10
16
9
2
14
12
15
13
17
8
3
7
6
5
4
1

DEVICE FOR THE FEEDING OF ENAMEL TO AN ELECTROSTATIC PAINT EMITTER

The invention concerns a device for feeding an electrically conductive enamel from a grounded supply system to a high voltage-connected electrostatic paint emitter with an intermediate storage which, chargeable up to a maximum fill level from the supply system in controlled fashion, is connected with the paint emitter via a paint line carrying a high voltage potential.

On prior devices for the electrostatic paint application, there exists between the electrically conductive enamel which is to be applied, on the one hand, and the surface to be painted, on the other, a potential difference which ensures that atomized enamel particles will be attracted by the surface to be painted. When the enamel is conductive, naturally, the enamel supply container pertaining to the respective paint emitter carries in relation to the article to be enameled the same potential difference; the article is usually grounded.

In large-scale enameling shops such as used, e.g., in the automobile manufacture, a repeated refilling of the supply container with enamel is necessary during the daily operation, even if these supply containers are dimensioned very large. For that purpose, the entire paint emitter device must be discharged and, after refilling of the supply container, again be charged to the original potential difference. This involves operational delays which interfere with the production. Therefore, buffer zones are necessary in the automobile production where unpainted automotive parts which arrive from the production line at a constant clock can be held in intermediate storage when it happens that a refill operation must be performed.

In order to reduce this expense, a system conceived by the filant was developed by the filant which enables a continuous operation by arranging between the supply system for paint and the actual supply container pertaining to the paint emitter an additional intermediate storage which alternately is grounded and connected to the supply system or imparted a potential difference relative to the supply system and connected to the supply container carrying the same potential. This makes it possible to continuously replenish the paint supply of the paint emitter during its continuous operation without having to shut down the paint emitter for that purpose.

A disadvantage of this system, though, is the relatively high constructional and technical expense which is necessary for the fabrication and operation of this system.

Therefore, the objective of the invention is to further advance the initially mentioned device in such a way that, while it permits the continuous operation of the paint emitter and the continuous replenishing of the intermediate storage coordinated with it, it requires nevertheless only a low constructional and operational expense.

This problem is inventionally solved in that with the intermediate storage there is coordinated a device for the breakup of the paint jet into electrically separate individual drops, which device is connectable to the supply system and so arranged above the fill level that from conductive surfaces in the intermediate storage there is a minimum distance such maintained that no electric arc-over can occur.

The jet of paint flowing into the intermediate storage is thus prevented from producing a conductance between the potential-carrying intermediate storage and the grounded supply system, since the paint jet is broken up into elements which electrically are not connected with one another. This requires, between the device for the breakup of the paint jet and the fill level, the maintenance of a distance such that no arc-over can occur by way of successive paint drops. In addition, it will in practical operation be advantageous to seek an additional safety through an electronic spark-suppressing device such as customary for electrostatic systems.

The device for the breakup of the paint jet may operate hydraulically by separating the paint jet into partial jets which are so introduced into one another that they will break up one another. The device may also operate pneumatically in that, e.g., a compressed air nozzle directed transverse at the paint jet will cause its separation. As the case may be, it may also be advantageous to use a mechanical device which, e.g., causes by means of a centrifugal wheel the disintegration of the impinging paint jet into individual drops.

According to one embodiment of the invention, it is, for purposes of achieving a particularly simple device and a particularly trouble-free operation, especially favorable to use an electric device which contains for the separation of the paint jet an electrically conductive, grounded paint feed tube whose open mouth faces the intermediate storage and is preferably arranged within its interior. Due to the potential difference between the grounded mouth and the paint charge contained in the intermediate storage, the paint jet is immediately broken up into individual droplets which proceed along electric flux lines. While the generation of these flux lines causes some discharge, the amperage reached thereby is so low that the operation of the paint emitter will not be influenced and the discharge can readily be compensated for by the high voltage supply coordinated with the paint emitter.

To reduce the distance necessary between the fill level and the mouth of the paint feed tube and thus enable with simpler means a more compact design yet, it is suggested according to one embodiment of the invention to arrange between mouth and fill level a baffle surface extending crosswise to the paint supply tube on which the paint jet at first impacts and is then deflected radially in the direction of the flux lines. The baffle surface may be constructed of electrically non-conductive material so as not to interfere with the generation of the flux lines between mouth and intermediate storage; as the case may be, it may as well be advantageous to select as baffle surface an electrically conductive baffle plate which, by its shape, makes it possible to take an influence on the flux line pattern and, thus, also on that of the liquid drops.

Basically, it is possible to construct the side walls of the intermediate storage from electrically conductive material, but this would require to select the distance from the mouth of the paint feed tube relatively large in order to prevent the paint from accumulating in an undesirable measure on the wall of the intermediate storage. According to one embodiment of the invention, it is thus of particular advantage that the side walls of the intermediate storage are constructed from electrically non-conductive material, since such enables a relatively compact design of the intermediate storage. Nevertheless, a minimum spacing between the mouth of the paint feed tube and the insulated side walls must be maintained in this case, too, since the side walls become conductive to a certain extent through the inevitable accumulation of a paint film.

In order to prevent an escape of paint droplets from the intermediate storage, it is necessary to extend its side walls relatively far beyond the mount of the paint feed tube, for it is practically not possible to seal the intermediate storage with a suitable lid, since in this case paint accumulations on the side walls and the lid would establish a conductive connection with the grounded paint feed tube.

To nevertheless enable a low overall height, it is suggested according to another preferable embodiment of the invention that above the intermediate storage, on the paint feed tube, a lid be arranged which, together with the top edge of the intermediate storage facing it, forms an annular gap. Naturally, this annular gap must be so dimensioned that an arc-over will be prevented. The lid prevents not only the undesirable escape of paint, but it forms additionally a mounting plate for accessory devices which are grounded and thus must not get into conductive connection with system components of the paint emitter.

According to a further embodiment of the invention, a preferable accessory is a ventilating device which effectuates the flushing of the intermediate storage with fresh air, thereby avoiding in sustained operation that in addition to the relatively large paint drops there will also be a paint mist formed which may have a relatively high electric charge and thus necessitates a relatively large minimum spacing between the mouth of the paint feed tube and the conductive surfaces of the intermediate storage. The ventilating device thus makes it possible to keep said minimum spacing, and thus also the dimensions of the inventional device, as small as possible.

As already indicated above, the lid which is suspended above the intermediate storage is particularly well suited as a support for components of the ventilating device; thus, another preferable embodiment of the invention is constituted in that the ventilating device comprises a ventilating socket which is arranged skew to the axis of the intermediate storage, passes through the lid, is attached to it, extends into the interior of the intermediate storage and can be connected on the outside of the intermediate storage to a fresh air supply. The skew arrangement of the ventilating socket generates a cyclone type circular flow in the interior of the intermediate storage; paint particles entrained by the scavenging air are thus removed at the side wall of the intermediate storage, which has a circular cross section, so that an expensive additional exhaust system for paint-laden air and the reclaimation of paint becomes unnecessary.

Basically, it is possible to provide between the device for the separation of the paint jet and the supply system to flow control valve permitting an adjustment of the paint flow such that a continuous paint jet will be steadily separated in the intermediate storage. The advantage of the continuous operation is that the entire system can be designed for relatively small flow rates, and therefore can be given an especially compact design. Since the paint emitter, as a rule, is not discharging paint continuously, an additional intermediate storage would again be necessary so as to establish a balance between the discontinuously operating paint emitter and the continuous paint feeding. According to another inventional embodiment, it is therefore particularly advantageous that in the intermediate storage there is a fill level measuring device provided with is in controlling connection with a shut-off valve that is incorporated between the supply system and the device for the separation of the paint jet. The fill level is thus discontinuously regulated by the opening and/or closing of the shut-off valve when predetermined limit values are reached; the respective feeding of paint is thus in keeping with the actual paint consumption of the paint emitter at a given time, so that an additional high voltage-connected intermediate storage becomes unnecessary.

According to another embodiment of the invention, the fill level measuring device features an air-inflated hose from insulating material which, for one, extends below the fill level into the intermediate storage and, for another, above the fill level into a transducer which converts the measured variable, which is constituted by air pressure fluctuations inside the hose, to control signals which are utilized to control the shut-off valve.

The object of the invention will be more fully explained with the aid of the attached schematic drawing. It shows a potential separation device which feeds electrically conductive, for instance, water-diluted enamel, material from a grounded paint circulation line system to an electrostatic paint emitter which is connected to high voltage potential, without any electric short circuit occurring between the two potentials.

Constructed on an insulated stand 1 with appropriate insulating properties is the collecting container 2. This collecting container is constructed from thick-walled specially treated high-pressure polyethylene. The bottom of the collecting container 2 has a funnel type design and comprises a metallic funnel insert with a metallic drain section 3. Arranged along the center axis of the collecting container 2 is an enamel feed tube 9 from steel. The tube end extending into the collecting container can be provided, if needed, with a metallic or insulating baffle plate 15. The enamel feed tube connects by way of a pneumatic two-way enamel valve with the enamel circulation line. The dimensions of the collecting container are selected sufficiently large for the centered enamel feeding tube 9 to have a radial distance of about 350 mm for the container inside wall. The distance between the discharge opening of the enamel feed tube 9 and/or 15 and the selective liquid level 8 on the container bottom amounts to about 300 mm.

The enamel feed tube 9 is mounted on a plastic lid 10 which, however, has no mechanical connection with the collecting container 2, thereby precluding the possibility of any electric bridging. The lid 10 is provided with a skew air supply socket 16 which, in turn, connects with an existing fresh air system. The fresh air introduced into the collecting container 2 via the socket 16 flushes the collecting container in the manner of a simple cyclone and removes, due to a slight overpressure, volatile gases from the collecting container. Directly connected with the metallic drain socket 3 of the collecting container 2 is the intake line of one or several insulated enamel pumps 4. The enamel pumps 4 are driven by means of an insulated shaft through a grounded motor with a gearing 6. The enamel pump pressure line 7 consists of a plastic hose and connects directly with the electrostatic spray element 14 (for instance, a spray bell). For control of the fill level 8 of the collecting container 2, the funnel-shaped bottom is provided with a plastic hose 13 which, in turn, is connected with a pressure control instrument 17. A rising liquid level 8 causes a pressure increase of the air column contained in the hose 13. This pressure increase and/or pressure reduction is converted by the pressure control instrument 17 to corresponding electric or pneumatic signals for control of the enamel valve 11 in the paint feed line 12. This enables an essentially constant height of the liquid level in the collecting container 2.

The paint circulation line 12, enamel valve 11, enamel feed tube 9, baffle plate 15, fresh air socket 16, pressure control instrument 17, and the drive aggregate 6 for the enamel pumps 4 are electrically connected to ground potential. In contrast, the funnel insert with the drain socket 3, the amount of paint contained in the intermediate storage, the enamel pump 4, and the spray element 14 are electrically connected with the same high voltage potential and are located within an enameling booth which is secured by door contacts and whose wall 18 is schematically illustated in the drawing.

Owing to the small dimensions of the potential separating device, as follows from the drawing, its accommodation inside the enameling booth is possible without any problem.

The operating mode of the illustrated device is as follows: If no potential difference exists between the collecting container bottom 3 and the enamel feed tube 9 and/or the baffle plate 15, the enamel material supplied by way of the valve 11 flows freely, in the form of a jet and/or large and, as the case may be, coherent drops, from the tube 9 to the container bottom 3. However, when the voltage is turned on and a potential difference exists between the container bottom 3 and the grounded feed tube 9, the enamel flow discharging from the tube 9 is immediately broken up into individual drops which proceed approximately along the electric flux lines. The zone of individual drops above the liquid level on the bottom depends directly, in its height, upon the potential difference. Contingent on the potential difference between the tube 9 and the bottom 8, a current in the order of about 0.1 to 0.4 mA is flowing. It is practically of no significance whether the grounded enamel material is supplied at an already existing potential difference or whether the potential difference is generated during the enamel feeding.

The arc-over of capacitive sparks within the device is primarily prevented by the dimensioning of the air and/or insulation gaps; additionally, an electrode spark suppressor incorporated in the high voltage circuit is effective.

What is claimed is:

1. A device for feeding an electrically conductive coating material from a supply system to a coating material dispensing device wherein a high electrostatic potential is maintained between the supply system and the device, comprising an intermediate storage container fillable in controlled manner from the supply system to a maximum fill level and connected to the coating material dispensing device by a coating material conduit maintained at substantially the electrostatic potential of the coating material dispensing device, a device provided in the intermediate storage container for breaking up the supply of coating material into the intermediate storage container into electrically separated individual particles, and means for coupling the breakup device to a source of coating material, the breakup device being arranged above the fill level such that, between the breakup device and the interior of the intermediate storage container, a minimum spacing in maintained so that no electrostatic discharge occurs, the intermediate storage container being dimensioned so that the coating material flow discharging from a delivery tube into the interior of the intermediate storage container flows freely in the form of an unconstrained column or large drops if no potential difference exists between the intermediate storage container and the delivery tube, but is broken up into individual drops which proceed somewhat along the electric flux lines established with the container as a potential difference is established, and while such potential difference exists, between the intermediate storage container and the delivery tube.

2. A device according to claim 1, characterized in that the delivery tube is an electrically conductive, grounded coating material feed tube (9) whose open delivery end faces the coating material in the intermediate storage container (2).

3. A device according to claim 2, characterized in that between the open delivery end and the coating material fill level (8) in the intermediate storage container there is arranged a baffle plate (15) which extends across the open delivery end.

4. A device according to claim 3, characterized in that the side walls of the intermediate storage container (2) are formed by electrically non-conductive material.

5. A device according to claim 4, characterized in that above the intermediate storage container (2) there is arranged, on the coating material feed tube (9), a lid (10) which, together with the intermediate storage container side wall rim adjacent it, forms an annular gap.

6. A device according to claim 5, characterized in that with the intermediate storage container (2) there is provided a ventilation device (16) for flushing the interior space of the intermediate storage container.

7. A device according to claim 6, characterized in that the ventilating device comprises a ventilating socket (16) which is arranged at an angle to the axis of the intermediate storage container (2), passes through the lid (10), is attached to the lid (10), extends into the interior of the intermediate storage, an air supply, and means for coupling the air supply to the ventilating socket.

8. A device according to claim 7, characterized in that in the intermediate storage container (2) there is arranged a measuring device (13, 17) for the fill level (8), which device is coupled in controllable fashion to a shut-off valve (11) which is provided between the supply system (1) and the device (9, 15) to halt the flow of coating material to the intermediate storage container.

9. A device according to claim 8, characterized in that the measuring device comprises an air-inflated hose (13) from insulating material which extends within the intermediate storage container (2) to below the fill level (8) and extends outside of the intermediate storage into an air pressure measuring instrument (17) which is arranged above the fill level.

* * * * *

UNITED STATES PATENT AND TRADEMARK OFFICE

CERTIFICATE OF CORRECTION

PATENT NO. : 4,413,788

DATED : November 8, 1983

INVENTOR(S) : Gerd Schaefer, Winfried Ott and Gunther Fleig

It is certified that error appears in the above-identified patent and that said Letters Patent is hereby corrected as shown below:

Column 3, line 57, "to" should be --a--.

Column 4, line 2, "with" should be --which--.

Column 4, line 43, "for" should be --from--.

Column 5, line 47, "electrode" should be --electronic--.

Column 6, line 5, "in" should be --is--.

Column 6, line 15, "with" should be --within--.

Signed and Sealed this

*Seventh* Day of *February 1984*

[SEAL]

*Attest:*

GERALD J. MOSSINGHOFF

*Attesting Officer*

*Commissioner of Patents and Trademarks*